US008454117B2

(12) United States Patent
Shimizu et al.

(10) Patent No.: US 8,454,117 B2
(45) Date of Patent: Jun. 4, 2013

(54) LIQUID EJECTING APPARATUS

(75) Inventors: Kazutoshi Shimizu, Shimosuwa-machi (JP); Yasushi Akatsuka, Higashichikuma-gun (JP); Norihiro Masuda, Matsumoto (JP); Kazutoshi Fujisawa, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 128 days.

(21) Appl. No.: 12/889,201

(22) Filed: Sep. 23, 2010

(65) Prior Publication Data

US 2011/0069113 A1 Mar. 24, 2011

(30) Foreign Application Priority Data

Sep. 24, 2009 (JP) ..... 2009-218625

(51) Int. Cl.
*B41J 2/015* (2006.01)

(52) U.S. Cl.
USPC ..... 347/21; 347/98; 347/100

(58) Field of Classification Search
None
See application file for complete search history.

(56) References Cited

U.S. PATENT DOCUMENTS

| | | | | |
|---|---|---|---|---|
| 4,680,058 | A * | 7/1987 | Shimizu et al. | 106/31.65 |
| 2005/0093952 | A1 * | 5/2005 | Hoshino | 347/102 |
| 2008/0143764 | A1 * | 6/2008 | Kaga et al. | 347/7 |

FOREIGN PATENT DOCUMENTS

| | | | |
|---|---|---|---|
| JP | 2005-153507 | A | 6/2005 |
| JP | 2008-296595 | A | 12/2008 |
| JP | 2008296595 | A * | 12/2008 |

OTHER PUBLICATIONS

Machine translation of JP 2008-296595 A.*
Translation of JP 2008-296595 A. Publication date of JP 2008-296595 A is Dec. 11, 2008.*

* cited by examiner

*Primary Examiner* — Matthew Luu
*Assistant Examiner* — Justin Seo
(74) *Attorney, Agent, or Firm* — Workman Nydegger

(57) ABSTRACT

A liquid ejecting apparatus includes a liquid ejecting head which ejects liquid containing metallic particles from a nozzle with respect to a target, the liquid ejecting head being disposed so that the nozzle opens facing a direction higher than a horizontal direction, and ejects the liquid from the nozzle facing the direction higher than the horizontal direction, thereby attaching the liquid to the target.

5 Claims, 2 Drawing Sheets

LIQUID EJECTING APPARATUS

BACKGROUND

1. Technical Field

The present invention relates to, for example, a liquid ejecting apparatus such as an ink jet type printer.

2. Related Art

Hitherto, a liquid ejecting apparatus for ejecting liquid with respect to a target, an ink jet type printer (hereinafter, also referred to as "printer") is widely known. The printer is adapted to perform printing to a recording medium as the target by ejecting ink (liquid), which is supplied to a recording head (a liquid ejecting head), from a nozzle formed in the recording head. In addition, in terms of this type of printer, recently, for example, as described in JP-A-2005-153507, there is a printer in which white ink is attached to a surface of the recording medium to perform a foundation treatment and a color ink (the recording material) including a color material is attached to an area, in which the foundation treatment has been performed, to perform the printing.

However, the white ink generally contains a large quantity of pigments (e.g., metallic particles such as titanium oxide) and has a greater specific weight than color ink containing pigments of other colors. For that reason, as in the printer of JP-A-2005-153507, in a case where the printing is performed with respect to the recording medium situated at a lower part of a vertical direction of the recording head, there is a concern that the pigment settles in the vicinity of a nozzle situated at the lower part with respect to the recording head, which causes blockage in the nozzle.

SUMMARY

An advantage of some aspects of the invention is to provide a liquid ejecting apparatus capable of suppressing the blockage of the nozzle that ejects liquid having a large specific weight.

A liquid ejecting apparatus according to an aspect of the invention includes a liquid ejecting head which ejects liquid containing metallic particles from a nozzle with respect to a target, the liquid ejecting head being disposed so that the nozzle opens facing a direction higher than a horizontal direction, and the liquid ejecting head ejecting the liquid from the nozzle in the direction higher than the horizontal direction, thereby attaching the liquid to the target.

According to the configuration, the liquid ejecting head is disposed so that the nozzle opens facing the direction higher than the horizontal direction. As a result, even in liquid which contains the metallic particles, and thus settling easily occurs, it is possible to suppress the settled metallic particles from being deposited in the vicinity of an opening of the nozzle. Thus, the blockage of the nozzle can be suppressed.

In the liquid ejecting apparatus according to the invention, the metallic particles are titanium oxide.

In general, a liquid that contains titanium oxide as a pigment has a specific weight higher than liquid containing pigments of other types. For that reason, in liquid containing titanium oxide, settling occurs more easily. Thus, according to the configuration, since the nozzle opens facing the direction higher than the horizontal direction, even in the case of ejecting liquid that contains titanium oxide and has the large specific weight, it is possible to suppress the titanium oxide from being deposited in the vicinity of the opening of the nozzle. That is, even in liquid which has a high content of the metallic particle per unit volume of liquid and has the large specific weight, the blockage of the nozzle is suppressed, whereby liquid can be satisfactorily ejected.

In the liquid ejecting apparatus according to the invention, a plurality of nozzles is formed in the liquid ejecting head, and the liquid ejecting head continuously ejects the liquid from the plurality of nozzles with respect to the target.

According to the configuration, by continuously ejecting liquid from the plurality of nozzles, an area to which liquid is attached is continuously formed on the target. Thus, even when some nozzles of the plurality of nozzles are blocked which makes it impossible to satisfactorily eject liquid, influence on picture quality can be reduced.

The liquid ejecting apparatus according to the invention further includes a recording unit which attaches recording material with respect to the target to perform the recording, the liquid ejecting head attaching the liquid with respect to a liquid attachment area on the target, and the recording unit attaching the recording material with respect to the liquid attachment area, thereby performing the recording.

According to the configuration, by attaching the liquid containing the metallic particles with respect to the liquid attachment area, it is possible to perform a desired recording with respect to the target regardless of the type of the target. That is, for example, even when the recording is performed with respect to a transparent target having excellent light permeability, a desired coloring of the recording material can be obtained by attaching the metallic particles to reduce the light permeability.

The liquid ejecting apparatus according to an aspect of the invention further includes a liquid receptor for accommodating the liquid therein; a liquid supply flow path which supplies the liquid from an upstream side which is the liquid receptor side to a downstream side which is the liquid ejecting head side; and a cleaning unit which pressurizes and supplies the liquid accommodated in the liquid receptor via the liquid supply flow path to the liquid ejecting head, and presses out the liquid from the nozzles, thereby performing the cleaning of the nozzles.

According to the configuration, by pressing out the liquid from the nozzles which open facing the direction higher than the horizontal direction, thereby performing the cleaning of the nozzles, an amount of liquid to be consumed can be reduced, as compared to a case where, for example, liquid in the nozzle is absorbed to perform the cleaning. As a result, the number of components can be reduced and the apparatus can be miniaturized, without needing to provide a configuration such as a cap for receiving liquid discharged due to the cleaning or a tank for storing waste liquid.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, a first embodiment embodying in an ink jet type printer (hereinafter, also referred to as "printer") of the invention will be described based on FIGS. 1 and 2. In addition, in the following description of the specification, "up and down direction" and "left and right direction" are shown on the basis of a direction shown by arrows in FIG. 1.

Figure 1:
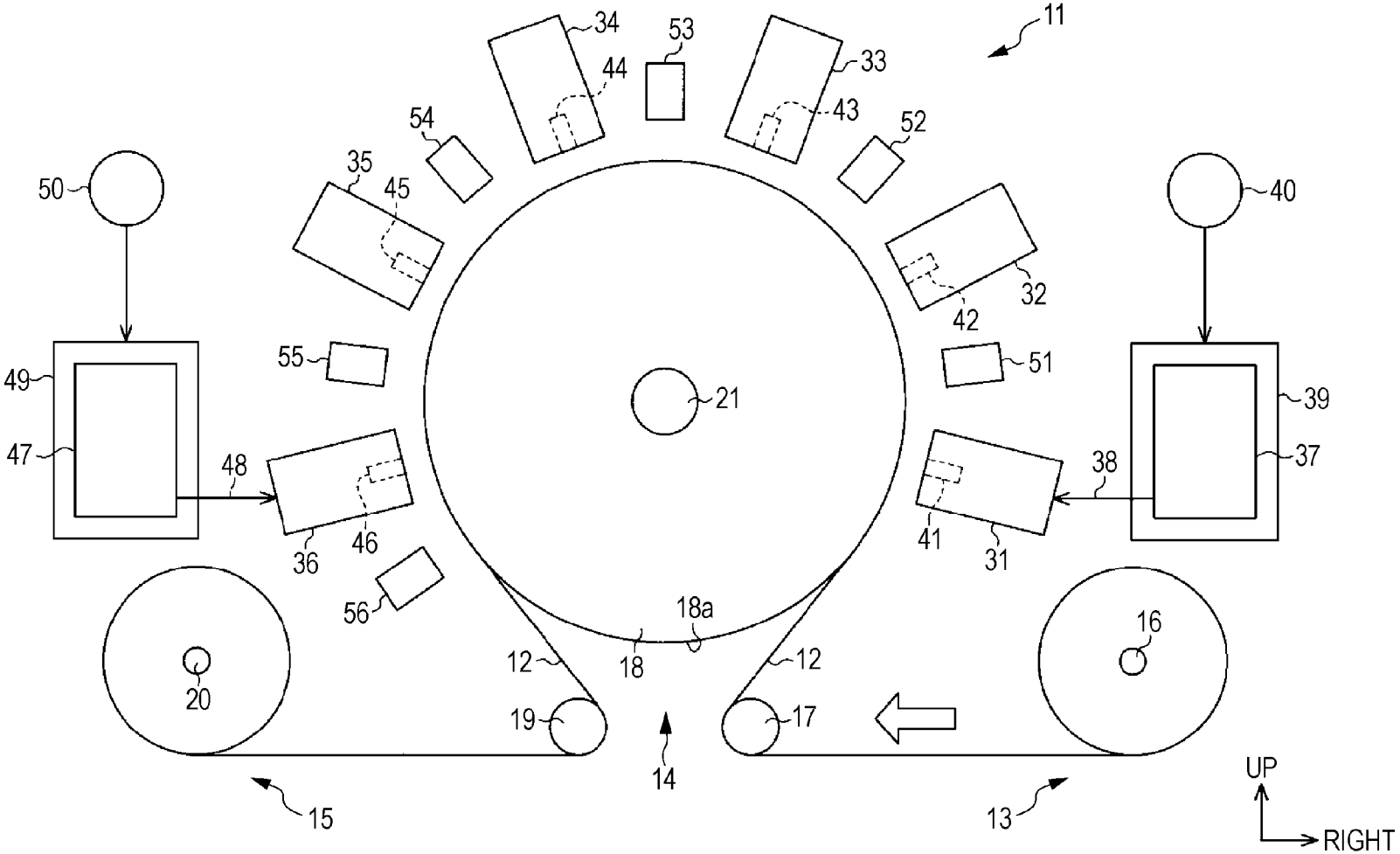
FIG. 1 is a diagram of a printer of a first embodiment.

As shown in FIG. 1, on a printer 11 as a liquid ejecting apparatus, an unwind portion 13 for unwinding a film 12 which is an elongated target, a printing portion 14 for printing (recording) the film 12, and a windup portion 15 for winding up the printed film 12.

That is, in a transport direction of the film 12 shown by a white arrow in FIG. 1, the unwind portion 13 is disposed at a position near a right side which is the upstream side, and the windup portion 15 is disposed at a position near a left side which is the downstream side. In addition, the printing portion 14 is disposed at a position between the unwind portion 13 and the windup portion 15.

In the unwind portion 13, a wind shaft 16 extending in a front and rear direction (a direction perpendicular to the paper in FIG. 1) is rotatably provided. In addition, in the wind shaft 16, the film with flexibility is supported so as to be rotatable integrally with the wind shaft 16 in the state of being wound in the form of a roll in advance. That is, the wind shaft 16 rotates due to the driving of a transport motor (not shown), so that the film 12 is unwound from the unwind portion 13 and is transported to the downstream side of the transport direction.

In addition, the film 12 unwound from the wind shaft 16 is sequentially wound up around a first roller 17, a platen drum 18 as a support member, and a second roller 19, so that after the transport direction is changed, the film 19 is wound around a windup shaft 20 provided on the windup portion 15.

The platen drum 18 provided on the printing portion 14 is a cylindrical body extending along the front and rear direction, and is supported so as to be rotatable integrally with a rotation shaft 21 which rotates due to the driving of the transport motor (not shown). In addition, the film 12 is wounded up around the platen drum 18 with tension added and is supported by a support surface 18*a* as a cylindrical surface of the shape of a curved surface. For that reason, when the rotation shaft 21 rotates, the film 12 is transported due to the rotation of the platen drum 18 which rotates together with the rotation shaft 21.

Furthermore, around the platen drum 18, a plurality (six in the present embodiment) of first to sixth heads 31 to 36 for ejecting ultraviolet curing ink which is cured in response to ultraviolet rays is disposed so as to surround the platen drum 18.

That is, at a position which is the uppermost stream side with respect to the transport direction, a first head 31 as a liquid ejecting head is disposed. A white ink pack 37 as a liquid receptor, which accommodates white ink (liquid) containing titanium oxide (metallic particles) as white pigment, is connected to the first head 31 via a white ink flow path 38 as a liquid supply flow path. In addition, a first booster pump 40 as the cleaning unit, which can supply air into a white ink cartridge 39 with the white ink pack 37 accommodated therein to pressurize the white ink pack 37, is connected to the white ink cartridge 39.

In addition, the first head 31 is disposed so that a plurality of first nozzles 41 formed along the front and rear direction faces the support surface 18*a* in a direction lower than halfway between the up and down direction (vertical direction) of the platen drum 18. That is, the first head 31 is disposed so that the first nozzles 41 open facing the direction higher than the horizontal direction perpendicular to the up and down direction (vertical direction).

In addition, at a position which is the downstream side of the first head 31 in the transport direction, a second to a fifth heads 32 to 35 as recording liquid ejecting heads and a recording unit are disposed for ejecting each color ink (the recording material and the recording liquid) containing pigments of each color of black, yellow, magenta, and cyan.

That is, the second head 32 disposed at the downstream side of the first head 31 is disposed so that second nozzles 42 as a plurality of recording liquid ejecting nozzles formed in the front and rear direction faces the support surface 18*a* in a direction higher than halfway between the up and down direction of the platen drum 18. That is, the second head 32 is disposed so that the second nozzles 42 open facing the direction lower than the horizontal direction. In addition, a black ink pack (not shown) accommodating the black ink is connected to the second head 32, so that the black ink is supplied on the basis of the pressurization of a booster pump (not shown).

Similarly, at the downstream side of the second head 32, a third head 33 to which yellow ink is supplied from a yellow ink pack (not shown) is disposed. In addition, at the downstream side of the third head 33, a fourth head 34 to which magenta ink is supplied from a magenta ink pack (not shown) is disposed. In addition, at the downstream side of the fourth head 34, a fifth head 35 to which cyan ink is supplied from a cyan ink pack (not shown) is disposed. The third to fifth heads 33 to 35 are disposed so as to face the support surface 18*a* in a direction higher than halfway between the up and down direction in the platen drum 18 such that the third to fifth nozzles 43 to 45 as a plurality of recording liquid ejecting nozzles formed along the front and rear direction open facing the direction lower than the horizontal direction.

In addition, at a position which is at the farthest downstream side in the transport direction, a sixth head 36 as a non-recoding liquid ejecting head is disposed. The sixth head 36 is disposed so that sixth nozzles 46 as a plurality of non-recording liquid ejecting nozzles formed along the front and rear direction face the support surface 18*a* in a direction lower than halfway between the up and down direction in the platen drum 18. That is, the sixth head 36 is disposed so that the sixth nozzles 46 open facing the direction higher than the horizontal direction.

In addition, a clear ink pack 47 as a non-recording liquid receptor in which transparent clear ink (non-recording liquid) is accommodated is connected to the sixth head 36 via a clear ink flow path 48 as a non-recording liquid supply flow path. Furthermore, a second booster pump 50 as a cleaning unit which can supply air into a clear ink cartridge 49, in which the clear ink pack 47 is accommodated, to pressurize the clear ink pack 47 is connected to the clear ink cartridge 49.

In addition, at the downstream sides of each transport direction of the first to sixth heads 31 to 36, first to sixth ultraviolet lights 51 to 56, which can irradiate the film 12 supported by the support surface 18*a* of the platen drum 18 with ultraviolet rays, are disposed so as to surround the platen drum 18. In addition, among the first to sixth ultraviolet lights 51 to 56, an amount of the ultraviolet irradiation of the sixth ultraviolet light 56 provided at the farthest downstream side is higher than those of other first to fifth ultraviolet lights 51 to 55.

Next, an operation in the case of performing the printing with respect to the printer 11 will be described based on FIGS. 1 and 2. In addition, in the present embodiment, the description will be given of the case in which printing data is input which prints mark A including letter "A" of alphabet as print data such as letters or image to be formed.

Figure 2:
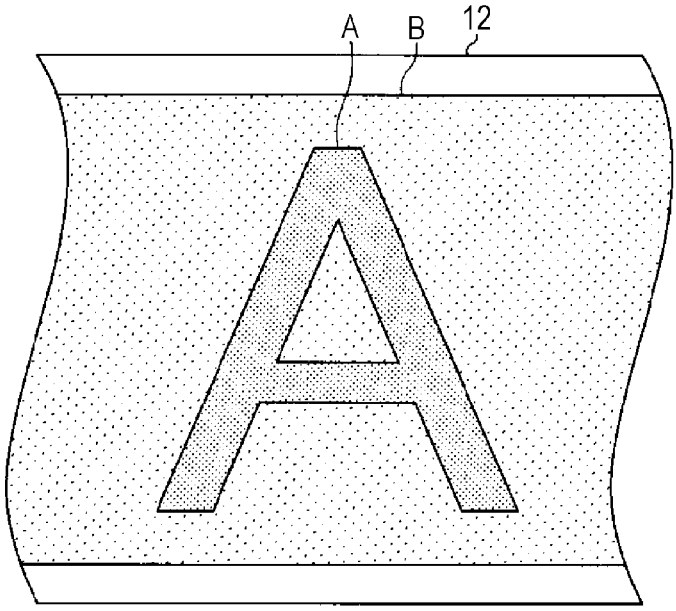
FIG. 2 is a diagram of a film.

As shown in FIG. 2, when print data is input, a control portion (not shown) first sets an area where mark A such as letter or figure is printed on the film 12 within a print area B as the liquid attachment area. In addition, as shown in FIG. 1, the control portion (not shown) drives a transport motor (not shown) and rotates the wind shaft 16, the first roller 17, the second roller 19, and the windup shaft 20, thereby transporting the film 12 to the downstream side of the transport direction.

When the film 12 is transported, firstly, the first head 31 continuously ejects the white ink from the whole first nozzles 41 formed in the first head 31 toward the print area B. At this time, since the first nozzles 41 open facing the direction higher than the horizontal direction, the first nozzles 41 eject the white ink in the direction higher than the horizontal direction. In addition, the print area B is an area to which ink can be attached in the area facing the first to sixth nozzles 41 to 46 in the film 12.

In addition, the white ink attached to the print area B of the film 12 is cured by irradiation of ultraviolet rays by the first ultraviolet light 51 disposed at the downstream side of the transport direction of the first head 31 along with the transportation of the film 12, thereby mobility declines.

Here, since the white ink contains a large quantity of white pigment per unit volume compared to ink of the other colors and has the large specific weight, the white pigment easily settles. However, since the white pigment settles in a vertically downward direction, in the first head 31 in which the first nozzles 41 open facing the direction higher than the horizontal direction, settling of the white pigment is suppressed in the vicinity of the opening. Thus, it is possible to eject the white ink in the state in which the blockage generated due to settling of the pigment in the vicinity of the openings of the first nozzles 41 is suppressed. Furthermore, gravity acts on the white ink ejected in the direction higher than the horizontal direction and a flight curve is generated, but the white ink is ejected and attached all over the print area B, so an influence on print quality due to a difference in attachment positions is small.

Next, the second to fifth heads 32 to 35 attaches the color ink with respect to the print area B, where the white ink is attached so that the foundation treatment is performed, thereby printing the mark A. That is, the second to fifth heads 32 to 35 eject the color ink of each color from the second to fifth nozzles 42 to 45 in the direction lower than the horizontal direction with respect to the area where the mark A of the film 12 is printed, thereby performing the printing treatment as the recording treatment (recording liquid ejecting process). For that reason, the color ink is attached to the film 12 in the state where there is a reduction in the flight curve generated by the influence of gravity. In addition, the color ink attached to the film 12 is cured by the irradiation of ultraviolet rays by the second to fifth ultraviolet lights 52 to 55, which are respectively disposed at the downstream side of the second to fifth head 32 to 35, whereby the printing is fixed.

When the film 12 is transported, the sixth head 36 ejects the clear ink from all of the sixth nozzles 46 formed in the sixth head 36 and attaches the clear ink to the print area B, thereby performing an overcoat treatment as an additional treatment (non-recording liquid ejecting stage).

In addition, the white ink, the color ink and the clear ink attached to the film 12 are cured by the irradiation of the ultraviolet rays of the sixth ultraviolet light 56, and are wound up around the windup shaft 20 in the state of being fixed to the film 12. In addition, since the sixth ultraviolet light 56 irradiates a large quantity of ultraviolet rays compared to other first to fifth ultraviolet lights 51 to 55, even in a case where there is uncured ink which is not cured when passing through the first to fifth ultraviolet lights 51 to 55, the uncured ink is cured when passing through the sixth ultraviolet light 56.

Next, an operation in a case of performing the cleaning of the first to sixth nozzles 41 to 46 in the printer 11 will be described based on the case of particularly performing the cleaning of the first nozzles 41 and the sixth nozzles 46.

Here, in the case of performing the cleaning of the first nozzles 41, firstly, a control portion (not shown) drives the first booster pump 40 to supply air into the white ink cartridge 39. Then, the white ink is pressurized and supplied from the white ink pack 37 pressurized within the white ink cartridge 39 via the white ink flow path 38 to the first head 31, so that the white ink is pressed out from the first nozzles 41 together with the white ink, with increased viscosity and dust.

Moreover, in the case of performing the cleaning of the sixth nozzles 46, a control portion (not shown) drives the second booster pump 50 to supply air into the clear ink cartridge 49. Then, the clear ink is pressurized and supplied from the pressurized clear ink pack 47 within the clear ink cartridge 49 via the clear ink flow path 48 to the sixth head 36, so that the clear ink is pressed out from the sixth nozzles 46 together with the clear ink with increased viscosity and dust.

In addition, in the first and the sixth heads 31 and 36, since the openings of the first nozzles 41 and the sixth nozzles 46 are disposed in the direction higher than the horizontal direction, the white ink and the clear ink pressed out from the first nozzles 41 and the sixth nozzles 46 are removed by a wiper (not shown) in the state in which the dropping of ink onto the support surface 18*a* is suppressed.

According to the first embodiment, the following effects can be obtained.

(1) The first head 31 is disposed so that the first nozzles 41 open facing the direction higher than the horizontal direction. As a result, even in a liquid which contains the white pigment whereby settling easily occurs, it is possible to suppress the settled white pigment from being deposited in the vicinity of the openings of the first nozzles 41. Thus, the blockage of the first nozzles 41 can be suppressed.

(2) The white ink which generally contains titanium oxide as the white pigment has a specific weight higher than ink containing other types of pigments. For that reason, settling easily occurs in the white ink containing titanium oxide. Thus, since the first nozzles 41 open facing the direction higher than the horizontal direction, even in the case of ejecting the white ink which contains titanium oxide and has large specific weight, it is possible to suppress titanium oxide from being deposited in the vicinity of the openings of the first nozzles 41. That is, even in the white ink which has the high specific weight and the high content of white pigment per unit volume of ink, the blockage of the first nozzles 41 is suppressed, whereby the white ink can be satisfactorily ejected.

(3) By continuously ejecting the white ink from the plurality of first nozzles 41, the print area B to which the white ink is attached is continuously formed in the film 12. Thus, even when some of the first nozzles 41 of the plurality of first nozzles 41 are blocked whereby the satisfactory ejection of the white ink cannot be performed, the influence on the picture quality can be reduced.

(4) By attaching the white ink containing the white pigment with respect to the print area B, it is possible to perform a desired printing with respect to the film 12 regardless of the type of the film 12. That is, for example, even when the printing is performed with respect to the transparent film 12 with excellent light permeability, by attaching the white pigment to reduce the light permeability of the target, a desired coloring of the color ink can be obtained.

(5) By pressing out the white ink from the first nozzles 41, which open facing the direction higher than the horizontal direction, thereby performing the cleaning of the first nozzles 41, the amount of the white ink to be consumed can be reduced as compared to the case of, for example, absorbing the white ink within the first nozzles 41 to perform the cleaning. For that reason, the number of components can be reduced and the apparatus can be miniaturized, without needing to prepare a configuration such as a cap for accommodating the white ink discharged due to the cleaning or a tank for storing waste liquid.

(6) Since the color ink, in which a difference in attachment positions influences print quality, is ejected in the direction lower than the horizontal direction and the flight curve is suppressed, whereby the clear ink having low influence on the print quality is ejected in the direction higher than the horizontal direction, a decline in print quality can be suppressed. In addition, since there is no need to arrange the second to fifth heads 32 to 35 and the sixth head 36 in a row, the printer 11 can be miniaturized.

(7) Since the color ink and the clear ink can be attached with respect to the film 12 in the state of being supported by the support surface 18*a* of the platen drum 18, the behavior of the film 12 is suppressed, whereby the print quality can be improved.

(8) Since the clear ink is transparent, even when the flight curve occurs in the ejected clear ink, the influence on the print quality can be reduced.

(9) By pressing out the clear ink from the sixth nozzles 46 which open facing the direction higher than the horizontal direction, thereby performing the cleaning of the sixth nozzles 46, the amount of clear ink to be consumed can be reduced as compared to the case of, for example, absorbing the clear ink within the sixth nozzles 46 to perform the cleaning. For that reason, the number of components can be reduced and the printer 11 can be miniaturized, without needing to prepare a configuration such as a cap for accommodating the clear ink discharged due to the cleaning or a tank for storing the waste liquid.

(10) Generally, in an absorption cleaning in which the nozzles formed in the head are covered with the cap and a negative pressure is generated in the cap, thereby absorbing ink, a seal portion formed of rubber is provided on an opening portion of the cap to improve air tightness. Here, since the seal portion is influenced by ultraviolet rays and easily deteriorates, in the printer provided with the ultraviolet light, there is a problem in that sealing properties of the cap cannot be maintained for a long time. Thus, by pressing out ink by using the booster pumps 40 and 50 to perform the cleaning, it is possible to reduce the influence of ultraviolet rays to perform the cleaning.

Second Embodiment

Next, a second embodiment of the invention will be described based on FIG. 3. In addition, the second embodiment is different from the first embodiment only in that the configuration of the printing portion is changed, and other configurations are the same, thus the same constituents are denoted by the same reference numerals and the detailed repetition description will be omitted.

Figure 3:
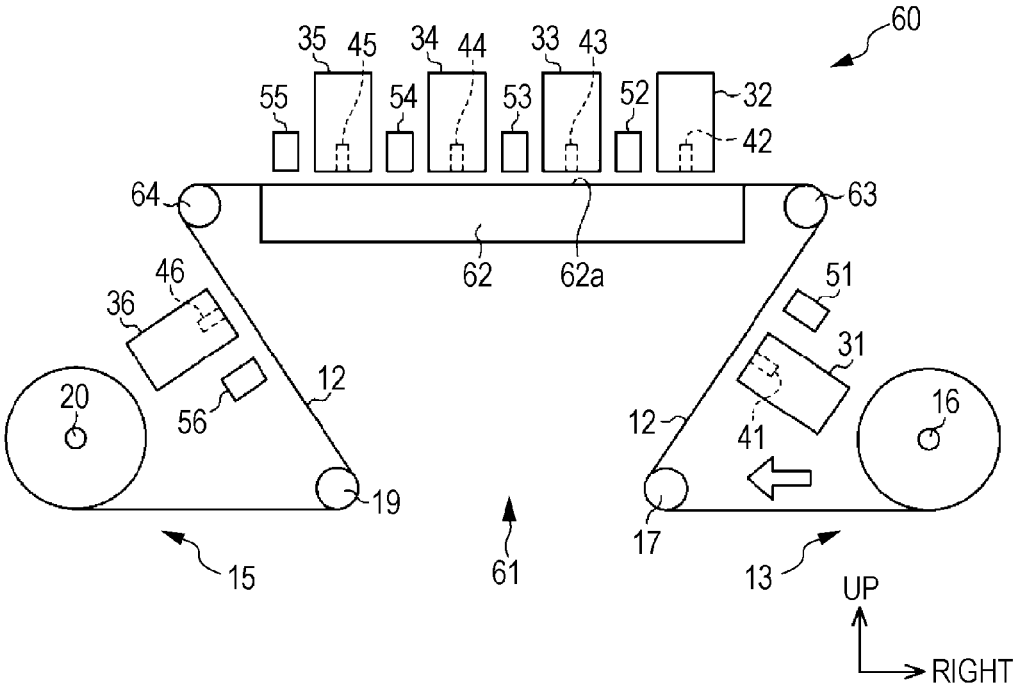
FIG. 3 is a diagram of a printer of a second embodiment.

As shown in FIG. 3, on the printing portion 61 of the printer 60, a platen 62 having a planar shape capable of supporting the film 12 is provided, and a third roller 63 and a fourth roller 64, which pinch the platen 62 therebetween and are opposed to each other in the left and right direction, are provided.

In addition, the film 12 unwound from the unwind portion 13 is sequentially wound around the first roller 17, the third roller 63, the fourth roller 64, and the second roller 19, and the transport direction of the film 12 shown by the white arrow in FIG. 3 is changed, the film 12 is wound around the wind shaft 20.

Furthermore, the first to sixth heads 31 to 36, which are respectively formed with the first to sixth nozzles 41 to 46, are provided on the printing portion 61 along the transport path of the film 12.

Specifically, the first head 31 disposed at the farthest upstream side with respect to the transport direction is provided at a position between the first roller 17 and the third roller 63 in the transport path of the film 12 in such a manner that the first nozzles 41 can face the film 12.

In addition, the third roller 63 provided at the right side of the platen 62 is provided in a direction higher than the first roller 17 and is provided in a direction further to the right than the first roller 17. For that reason, in the transport path of the film 12 reaching from the first roller 17 to the third roller 63, the film 12 is adapted to be transported in the state in which the surface of the film 12, to which the white ink is attached, faces the lower side.

That is, the first head 31 is provided so that the first nozzles 41 open facing the direction higher than the horizontal direction, thereby ejecting the white ink in the direction higher than the horizontal direction.

In addition, the second to fifth heads 32 to 35, which are provided farther at the downstream side of the transport direction than the first head 31, are provided at the upper part of the platen 62 so that the second to fifth nozzles 42 to 45 face the support face 62*a* of the platen 62 that supports the film 12. That is, the second to fifth heads 32 to 35 are adapted so that the second to fifth nozzles 42 to 45 are provided so as to be open in a vertically downward direction, thereby ejecting the color ink in a vertically downward direction with respect to the surface of the film 12 supported by the platen 62.

In addition, the sixth head 36 disposed at the farthest downstream side with respect to the transport direction is provided so that the sixth nozzles 46 can face the film 12 at the position between the fourth roller 64 and the second roller 19 in the transport path of the film 12.

In addition, the fourth roller 64 provided at the left part of the platen 62 is provided at a position higher than the second roller 19 and is provided at a position further to the left than the second roller 19. For that reason, in the transport path of the film 12 reaching from the fourth roller 64 to the second roller 19, the film 12 is adapted to be transported in the state in which the surface, to which the clear ink is attached, faces the lower side.

That is, the sixth head 36 is provided so that the sixth nozzles 46 open facing the direction higher than the horizontal direction, thereby ejecting the clear ink in the direction higher than the horizontal direction.

In addition, at the downstream sides of the transport direction of the respective heads 31 to 36, the first to sixth ultraviolet lights 51 to 56 are respectively provided so that they can irradiate the film 12 with ultraviolet rays.

According to the second embodiment, in addition to the effects of (1) to (10) in the first embodiment, the following effects can be obtained.

(11) Since the second to fifth heads 32 to 35 are disposed so that the second to fifth nozzles 42 to 45 open toward the lower part, it is possible to suppress the flight curve of the color ink ejected from the second to fifth nozzles 42 to 45, thereby further suppressing the decline in print quality.

In addition, the above embodiments can be modified as follows:

In each embodiment, the second to fifth nozzles 42 to 45 may be subjected to pressurization cleaning in the same manner as the first and sixth nozzles 41 and 46. Furthermore, the cap for covering the first to sixth nozzles 41 to 46 may be provided, thereby performing absorption cleaning.

In each embodiment, the first and the sixth heads 31 and 36 may be disposed so that the first and the sixth nozzles 41 and 46 open in a vertically upward direction, thereby ejecting the white ink or the clear ink in a vertically upward direction.

In each embodiment, the white ink may be attached to the film 12 by a liquid ejecting apparatus which is individually equipped with the first head 31, thereby performing the foundation treatment. In addition, the film 12 or the film 12 in which the foundation treatment is performed may be transported to the liquid ejecting apparatus including the second to sixth heads 32 to 36, so that the film 12 is printed by the liquid ejecting apparatus.

In each embodiment, the first and the sixth heads 31 and 36 may be heads in which only one of the first and the sixth nozzles 41 and 46 opens, for example, like a spray. Furthermore, the white ink or the clear ink may be sprayed from one of the first and the sixth nozzles 41 and 46. In addition, the white ink and the clear ink may be attached to only the area where the mark A is printed, and may be attached to only an area other than the area where the mark A in the printing area B is printed.

In each embodiment, the white ink may contain metallic particles such as titanium dioxide (titanium oxide), white lead, magnesium oxide, barium sulfate, calcium carbonate, zinc oxide (zinc flowers), and mixture (lithopone) of zinc sulfide and barium sulfate, as the white pigment, and may contain the mixture of the metallic particles thereof.

In each embodiment, as the metallic particles, a metal ink (liquid) which contains particles such as gold, silver and aluminum as pigments may be ejected from the first head 31. In addition, the metal ink is ink which can form a metallic foil or perform lustrous printing by being attached and fixed to the film 12.

In each embodiment, the target to be printed may be a film formed by a material, which is not permeable to ink, such as resin, metal, glass and ceramic, or a paper made of plant fiber as a raw material which is permeable to ink. Moreover, the printing may be performed by ink fixed to the film 12 by being permeated or dried, without preparing the ultraviolet lights 51 to 56.

In the second embodiment, a transport belt of an endless shape may be wound around the first roller 17, the third roller 63, the fourth roller 64 and the second roller 19, thereby performing the printing, for example, with respect to a stripe shaped target which is electrostatically absorbed to the transport belt and is transported.

In each embodiment, the white ink may be attached to the rear surface of the film 12 to perform the foundation treatment, and the color ink may be attached to the surface of the film 12 to perform the printing. That is, in a case where, for example, the foundation treatment is performed with respect to the transparent film 12, thereby performing a desired coloring of the color ink, the surface in which the foundation treatment is performed can be arbitrary selected.

In each embodiment, the white ink may be ejected from the sixth head 36, whereby the overcoat treatment is performed by the white ink.

In each embodiment, a gear pump or a pulsation type pump may be provided on the white ink flow path 38 and the clear ink flow path 48, thereby supplying the ink to the first and the sixth heads 31 and 36 by the pump. That is, the pump is driven to absorb each ink within the white ink pack 37 and the clear ink pack 47, and the supplying of ink to the first and the sixth heads 31 and 36 and the cleaning of the first and the sixth nozzles 41 and 46 may be performed.

In the first embodiment, the platen 18 is not provided, and, for example, a plurality of rollers is be disposed in a circular shape, an oval shape, or a rectangular shape, so that the film 12 may be wound around the rollers and be transported.

In the first embodiment, the platen drum 18 may be an oval column, a square column or the like which is fixed so as not to be rotated. In addition, in the case of a prism, it is desirable that an angular portion be chamfered.

In the second embodiment, the platen 62 may not be provided. Furthermore, at a position facing the first head 31 and the sixth head 36, a support member for supporting the film 12 may be provided.

Although, in the above-mentioned embodiments, the liquid ejecting apparatus is embodied in the ink jet type printers 11 and 60, a liquid ejecting apparatus which ejects or discharges liquid other than ink may be adopted. Various liquid ejecting apparatuses which include a liquid ejecting head or the like for discharging liquid droplets of a minute amount may be adopted. In addition, the liquid droplets refers to a liquid state discharged from the liquid ejecting apparatus, and also includes liquid droplets which have a particulate shape, a tear shape, and extending in a thread shape. Moreover, the liquid may be a material that can be ejected by the liquid ejecting apparatus. For example, a liquid which is in the state when a substance is a liquid phase may be used, and the liquid includes a liquid as a flow state or a liquid state of substance such as liquefied body with high or low viscosity, colloid solution, gel water, other inorganic solvent, organic solvent, solution, liquefied resin, and liquefied metal (metal solution), as well as a liquid in which particles of functional material including a solid matter such as pigment or metallic particle are dissolved, dispersed or mixed in the solvent. Furthermore, as a typical example of the liquid, the ink, the liquid crystal or the like as described in the above-mentioned embodiments can be included. Herein, the ink includes various liquid composites such as general aqueous ink, oil-based ink, and gel ink, and hot melt ink. As a specific example of the liquid ejecting apparatus, a liquid ejecting apparatus for ejecting liquid, which includes, for example, materials such as an electrode material or a color material used for producing a liquid crystal display, an EL (Electro Luminescent) display, a flat fluorescent display, a color filter or the like, in the form of dispersion or dissolution, a liquid ejecting apparatus for ejecting biological organics which is used for producing a bio chip, a liquid ejecting apparatus for ejecting liquid which is used as a precision pipette, and is a sample, a textile printing apparatus, a micro dispenser or the like may be used. In addition, a liquid ejecting apparatus which ejects lubricant oil to precision machinery such as a watch and a camera by a pin point, a liquid ejecting apparatus which ejects a transparent resin liquid such as ultraviolet curing resin onto a substrate to form a micro hemispherical lens (an optical lens) or the like that is used in an optical communication element or the like, and a liquid ejecting apparatus which ejects an etching liquid such as acid or alkali to etch the substrate or the like may be adopted. In addition, the invention can be applied to any one type of liquid ejecting apparatus of those mentioned above.

The entire disclosure of Japanese Patent Application No. 2009-218625, filed Sep. 24, 2009 is expressly incorporated by reference herein.

What is claimed is:

1. A liquid ejecting apparatus comprising:

a first liquid ejecting head which ejects a first liquid containing metallic particles from a first nozzle onto a target, the first liquid ejecting head being disposed so that a nozzle opening of the first nozzle faces a first direction which is higher than a horizontal direction, and ejects the liquid from the first nozzle in the first direction, thereby attaching the liquid to the target, wherein having the first nozzle open in the first direction is configured to suppress blockage of the first nozzle opening by settling of the first liquid; and a second liquid ejecting head that ejects a second liquid containing a color pigment onto the target from a second nozzle, the second liquid ejecting head being disposed so that a second nozzle opening of the second nozzle faces a second direction that is lower than a horizontal direction, wherein having the second nozzle open in the second direction is configured to suppress a liquid flight curve generated by the influence of gravity.

2. The liquid ejecting apparatus according to claim 1, wherein the metallic particles are titanium oxide.

3. The liquid ejecting apparatus according to claim 1, wherein a plurality of the first nozzles is formed in the first liquid ejecting head, and wherein the first liquid ejecting head is configured to continuously eject the first liquid from the plurality of first nozzles onto the target.

4. The liquid ejecting apparatus according to claim 1, wherein the first liquid ejecting head ejects the first liquid onto a liquid attachment area on the target, and wherein the second liquid ejecting head ejects the second liquid onto the liquid attachment area, thereby performing the recording.

5. The liquid ejecting apparatus according to claim 1, further comprising:

a liquid receptor for accommodating the liquid therein;

a liquid supply flow path which supplies the first liquid from an upstream side which is the liquid receptor side to a downstream side which is the first liquid ejecting head side; and a cleaning unit which pressurizes and supplies the liquid accommodated in the liquid receptor via the liquid supply flow path to the first liquid ejecting head, and presses out the first liquid from the first nozzles, thereby performing the cleaning of the nozzles.

* * * * *